US006597260B2

(12) United States Patent
Sasaki et al.

(10) Patent No.: US 6,597,260 B2
(45) Date of Patent: Jul. 22, 2003

(54) FILTER, MULTIPLEXER, AND COMMUNICATION APPARATUS

(75) Inventors: Yutaka Sasaki, Yokohama (JP); Tomiya Sonoda, Yokohama (JP); Toshito Hiratsuka, Yokohama (JP); Koichi Sakamoto, Yokohama (JP)

(73) Assignee: Murata Manufacturing Co. Ltd. (JP)

( * ) Notice: Subject to any disclaimer, the term of this patent is extended or adjusted under 35 U.S.C. 154(b) by 0 days.

(21) Appl. No.: 09/948,206

(22) Filed: Sep. 6, 2001

(65) Prior Publication Data

US 2002/0027483 A1 Mar. 7, 2002

(30) Foreign Application Priority Data

Sep. 6, 2000 (JP) ..... 2000-270512

(51) Int. Cl.[7] ..... H01P 5/12
(52) U.S. Cl. ..... 333/134; 333/202; 333/212
(58) Field of Search ..... 333/134, 202, 333/219.1, 212, 208, 222, 239, 206, 135

(56) References Cited

U.S. PATENT DOCUMENTS 4,725,798 A * 2/1988 Igarashi ..... 333/212
5,945,894 A 8/1999 Ishikawa et al.
104,261 A * 8/2000 Sonda et al. ..... 333/202
6,101,300 A * 8/2000 Fan et al. ..... 385/27
6,201,456 B1 * 3/2001 Hiratsuka et al. ..... 333/134
6,249,195 B1 * 6/2001 Mikami et al. ..... 333/134
6,356,170 B1 * 3/2002 Arakawa et al. ..... 333/208

FOREIGN PATENT DOCUMENTS

| | | |
|---|---|---|
| EP | 0 948 077 | 10/1999 |
| EP | 0 949 707 | 10/1999 |
| EP | 0 966 055 | 12/1999 |
| JP | 11234008 | 8/1999 |

OTHER PUBLICATIONS

UK Search Report dated May 15, 2002.

* cited by examiner

*Primary Examiner*—Brian Young
*Assistant Examiner*—John Nguyen
(74) *Attorney, Agent, or Firm*—Dickstein, Shapiro, Morin & Oshinsky, LLP.

(57) ABSTRACT

Electrodes are formed on both surfaces of a dielectric plate. Openings are formed in the electrodes such that pairs of openings face each other through the dielectric plate. Each pair of electrode openings defines a resonator. The resonators positioned at the ends of the dielectric plate are directly coupled to a waveguide formed by a package base and a package cover.

10 Claims, 7 Drawing Sheets

FILTER, MULTIPLEXER, AND COMMUNICATION APPARATUS

BACKGROUND OF THE INVENTION

1. Field of the Invention

The present invention relates to a filter and a multiplexer for use in the microwave or millimeter-wave band, and also to a communication apparatus provided with the above-described filter and multiplexer.

2. Description of the Related Art

In a conventional dielectric resonator device, a planar-circuit-type dielectric resonator is coupled to an input/output portion, such as a coupling probe, a suspended line, or an NRD guide, as disclosed in Japanese Unexamined Patent Application Publication No. 11-234008. In the above-described dielectric resonator device, an electrode provided with an opening is disposed on each surface of a dielectric plate, and the opposing electrode openings serve as resonators. Accordingly, the dielectric resonator device may be used as, for example, a compact band-pass filter with a small insertion loss.

The use of an input/output line, such as a microstrip line or a suspended line, as an excitation line of the above-described resonator will be referred to as "indirect coupling." With indirect coupling, a current flows in the input/output line due to magnetic coupling caused by excitation. This incurs a conduction loss, thereby increasing the insertion loss when the dielectric resonator device is used as a filter. Additionally, when the above-described dielectric resonator device is connected to a module using a waveguide as an input/output portion, which is frequently used in a millimeter-wave device, it is necessary to swap the waveguide with the microstrip line or the suspended line, which causes a poor connection.

SUMMARY OF THE INVENTION

Accordingly, the present invention provides a filter and a multiplexer, and a communication apparatus provided with the filter and/or the multiplexer, without a conduction loss caused by input/output lines or a poor connection with a transmission line, such as a waveguide.

According to one aspect of the present invention, there is provided a filter including a resonator having electrodes on both surfaces of a dielectric plate, the electrodes being provided with electrode openings which face each other via the dielectric plate. In the filter, a waveguide is directly coupled to the resonator, that is, the waveguide is coupled to the resonator without using an input/output line such as a microstrip line or a suspended line as an excitation line.

By directly coupling the resonator formed on the dielectric plate and the waveguide, a conduction loss caused by an input/output line, such as a microstrip line or a suspended line, can be prevented. The connection of the resonator with a module using the waveguide as an input/output portion can also be enhanced.

In the above-described filter, at least one end of the resonator coupled to the waveguide may be opened. With this structure, the magnetic field leakage of the resonator can be increased, thereby facilitating a strong coupling force with the waveguide.

The width of the opened end may be set so that a desired external Q is obtained. For example, the electrode opening at the opened end may partially be narrowed. With this structure, the level of a coupling force with an external source, i.e., the waveguide, can be easily determined.

In the aforementioned filter, electromagnetic waves may propagate in the waveguide perpendicularly to the surface of the dielectric plate. With this arrangement, the connection and the mountability of the mounting portion of the dielectric plate, which forms the filter, to the waveguide can be improved.

In the filter in which the electromagnetic waves propagate in the waveguide perpendicularly to the surface of the dielectric plate on which the electrode openings are formed, the electrode opening may be extended into the waveguide by up to an amount corresponding to the resonant wavelength of the resonator, that is, by up to the maximum length from one end to the other end of the electrode opening in the longitudinal direction of the filter. With this configuration, a predetermined external Q (Qe) can be obtained.

In the above-configured filter, a length of the resonator directly coupled to the waveguide is preferably $(2n-1)/4$ or $2n/4$ of a resonant wavelength (where n is an integer of one or more). In such a case, the electrode opening is preferably inserted into the waveguide by an amount corresponding to $(m-1)/2$ (where m ranges from 2 to n) of the resonant wavelength in the longitudinal direction of the electrode opening. With this arrangement, the coupling strength between the resonator and the waveguide can be increased, and a change in the external Qe relative to the back short can be decreased, thereby stabilizing the filter characteristics.

According to another aspect of the present invention, there is provided a multiplexer including a plurality of the filters having any of the above-described configurations.

According to still another aspect of the present invention, there is provided a communication apparatus including the aforementioned filter or multiplexer.

Other features and advantages of the invention will become apparent in view of the following detailed description of embodiments thereof, including the drawings, in which like references denote like elements and parts.

DESCRIPTION OF EMBODIMENTS OF THE INVENTION

Figure 1A:
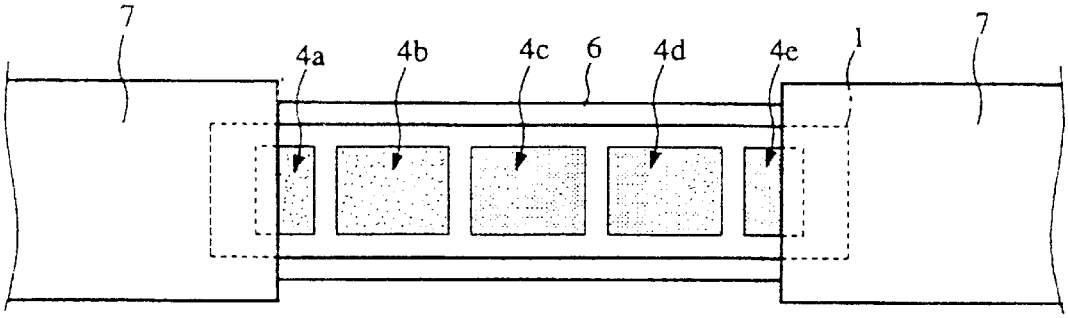
FIGS. 1A and 1B illustrate the configuration of a filter according to a first embodiment of the present invention.
Figure 1B:
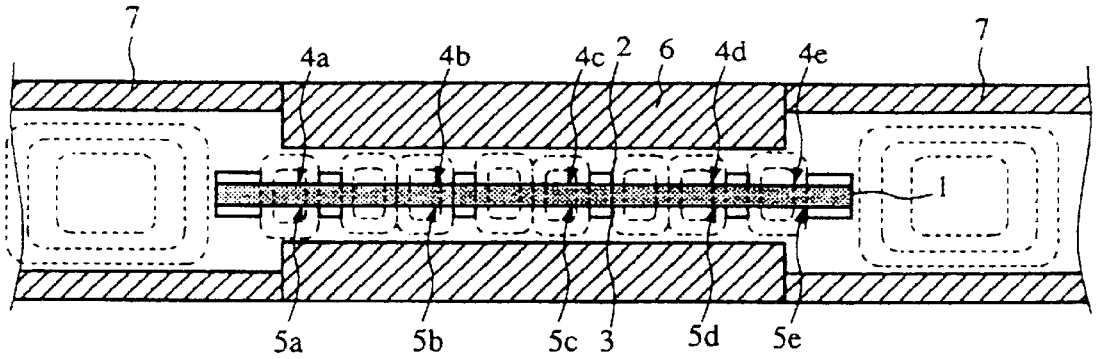

The configuration of a filter according to a first embodiment of the present invention is described below with reference to FIGS. 1A and 1B. FIG. 1A is a top view illustrating the filter from which an upper lid is partially removed, and FIG. 1B is a longitudinal sectional view of the center of the filter. In FIGS. 1A and 1B, electrodes 2 and 3 are respectively disposed on the top and bottom surfaces of a dielectric plate 1. Electrode openings 4*a* through 4*e* and electrode openings 5*a* through 5*e* are provided so that they face each other with the dielectric plate 1 therebetween. The portion of the dielectric plate 1 sandwiched between each pair of electrode openings serves as a rectangular slot-mode resonator. More specifically, the portion of the dielectric plate 1 between the electrode openings 4*a* and 5*a,* and the portion between the electrode openings 4*e* and 5*e* serve as TE101-mode dielectric resonators (½-wavelength resonators). The portion between the electrode openings 4*b* and 5*b,* the portion between the electrode openings 4*c* and 5*c,* and the portion between the electrode openings 4*d* and 5*d* serve as TE102-mode dielectric resonators (1-wavelength resonators).

The dielectric plate 1 is housed in a metallic package 6, which forms a conductor plane, with a predetermined spacing from the electrodes 2 and 3. In FIG. 1A, the inside of the filter is shown by partially removing the upper lid. A rectangular waveguide 7 is connected to the 10 package 6. The dashed lines shown in FIG. 1B indicate the distribution of magnetic fields generated in the package 6 and the waveguide 7. TE10-mode electromagnetic waves propagate in the waveguide 7. The magnetic-field distribution of the TE10-mode electromagnetic waves becomes parallel to that of the TE101-mode electromagnetic waves generated by the dielectric plate 1, and the two modes are thus coupled.

With the above arrangement, the aforementioned resonator device serves as a filter which uses the waveguide 7 as an input/output portion and which exhibits band-pass characteristics generated by the five dielectric resonator stages.

As discussed above, the resonator device is directly connected to the waveguide without using an input/output line, such as a microstrip line, a suspended line, or a coaxial probe. It is thus possible to obtain a low-insertion-loss filter without a conduction loss caused by an input/output line.

Figure 2:
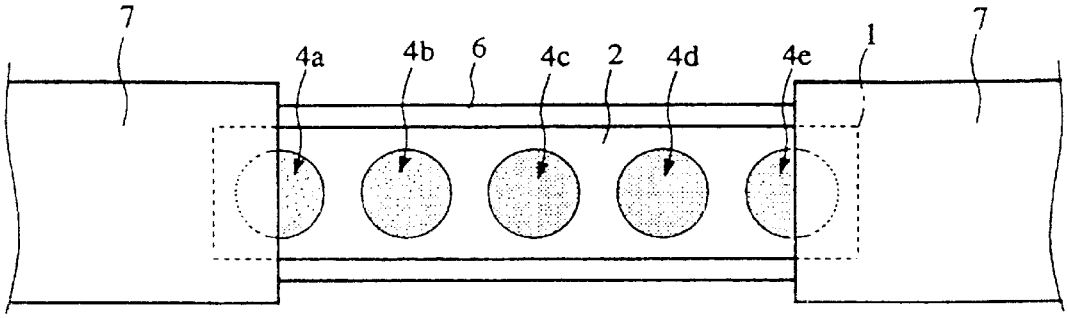
FIG. 2 illustrates the configuration of a filter according to a second embodiment of the present invention.

A description is now given of the configuration of a second embodiment of the present invention with reference to FIG. 2. In the first embodiment shown in FIGS. 1A and 1B, rectangular electrode openings are provided in the dielectric plate 1 so as to form rectangular slot-mode dielectric resonators. In the second embodiment, however, circular electrode openings are provided. The electrode openings 4*a* through 4*e* are provided on the top surface of the dielectric plate 1, and electrode openings having the same configurations as those of the electrode openings 4*a* through 4*e* are disposed at positions on the bottom surface facing the electrode openings 4*a* through 4*e*. The electrode openings of the dielectric plate 1 serve as circular TE010-mode dielectric resonators. The magnetic-field distribution of the predetermined electrode openings becomes parallel to that of the TE10-mode electromagnetic waves generated in the waveguide 7, and the two modes are thus electromagnetically coupled.

Figure 3A:
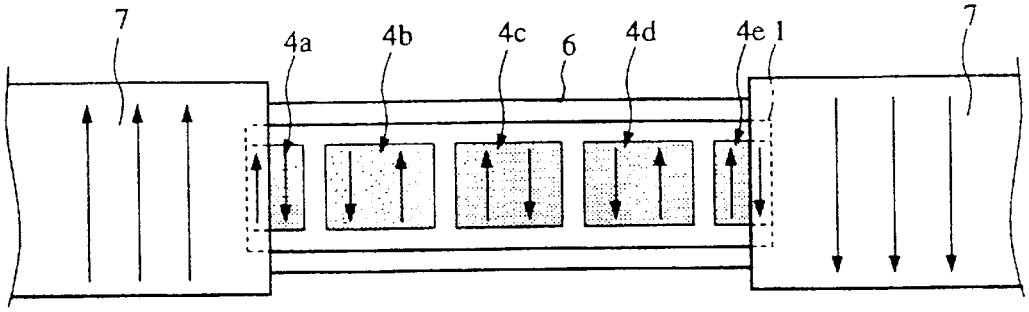
FIGS. 3A and 3B illustrate the configuration of a filter according to a third embodiment of the present invention.
Figure 3B:
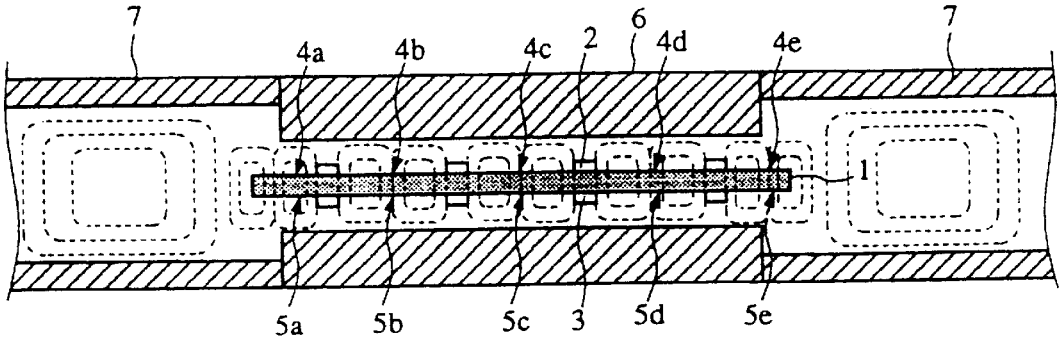

The configuration of a filter according to a third embodiment of the present invention is discussed below with reference to FIGS. 3A and 3B. Unlike the first embodiment shown in FIGS. 1A and 1B, one end of each of the resonators formed respectively by the opposing electrode openings 4*a* and 5*a* and the opposing electrode openings 4*e* and 5*e* is short-circuited, and the other ends of the above-described resonators, the ends adjacent to the waveguide 7, are opened. With this arrangement, the above-described electrode openings serve as ¾-wavelength resonators. The electrode openings 4*a* and 5*a* and the electrode openings 4*e* and 5*e* are provided up to the edges of the dielectric plate 1 facing the waveguide 7. The other resonators, such as the one formed by the electrode openings 4*b* and 5*b,* the one formed by the electrode openings 4*c* and 5*c,* and the one formed by the electrode openings 4*d* and 5*d,* serve as 1-wavelength resonators. The arrows shown in FIG. 3A indicate the electric-field distribution of the rectangular slot-mode resonators formed in the dielectric plate 1, and the electric-field distribution of the TE10-mode resonators formed in the waveguide 7. The dashed lines shown in FIG. 3B represent the magnetic-field distribution of the above-described resonators.

The resonators formed by the electrode openings 4*a* and 5*a* and the electrode openings 4*e* and 5*e* are not restricted to being ¾-wavelength resonators, and more generally may be (2n−1)/4-wavelength resonators (n is an integer of 1 or more).

Accordingly, by coupling the resonators having opened ends to the waveguide 7 as discussed above, a conduction loss caused by a current flowing in electrodes located at the ends of the resonators (at the edges of the dielectric plate 1) can be eliminated, thereby further reducing the insertion loss of the filter. Additionally, the magnetic field leakage becomes larger at the opened ends of the resonators, thereby facilitating a strong coupling force with the waveguide 7.

Figure 4:
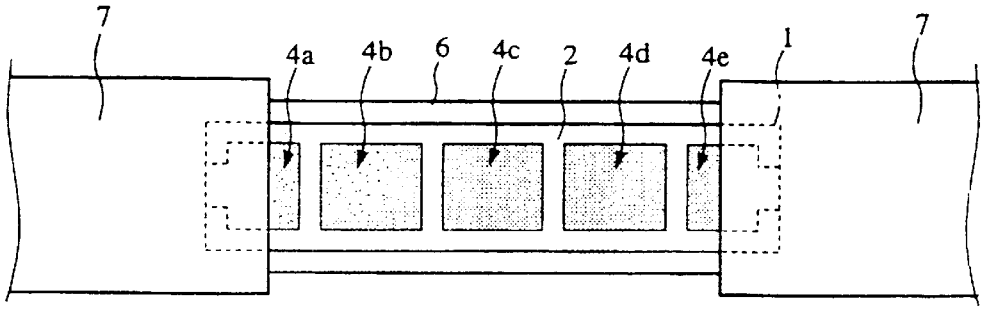
FIG. 4 illustrates the configuration of a filter according to a fourth embodiment of the present invention.

FIG. 4 illustrates the configuration of a filter according to a fourth embodiment of the present invention. As in FIG. 3A, FIG. 4 is a top view illustrating the filter from which an upper lid of the package 6 is removed. In this embodiment, the widths of the opened ends of the resonators formed at the edges of the dielectric plate 1 connected to the waveguide 7 are formed smaller than those shown in FIGS. 3A and 3B, and likewise smaller than the corresponding electrode widths. The magnetic field leakage becomes smaller as the widths of the opened ends are decreased, and vice versa. Thus, the level of a coupling force with the waveguide can be set and adjusted by determining the widths of the opened ends.

A description is now given of the configuration of a filter according to a fifth embodiment of the present invention with reference to FIGS. 5A through 8.

In the foregoing embodiments, electromagnetic waves propagate in the waveguide in the longitudinal direction of the dielectric plate. In the fifth embodiment, however, electromagnetic waves propagate in the waveguide perpendicular to the longitudinal direction of the dielectric plate.

Figure 5A:
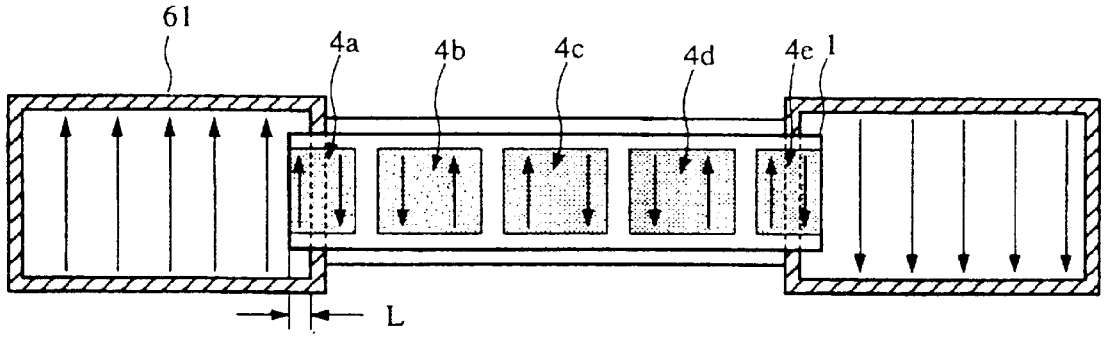
FIGS. 5A and 5B illustrate the configuration of a filter according to a fifth embodiment of the present invention.
Figure 5B:
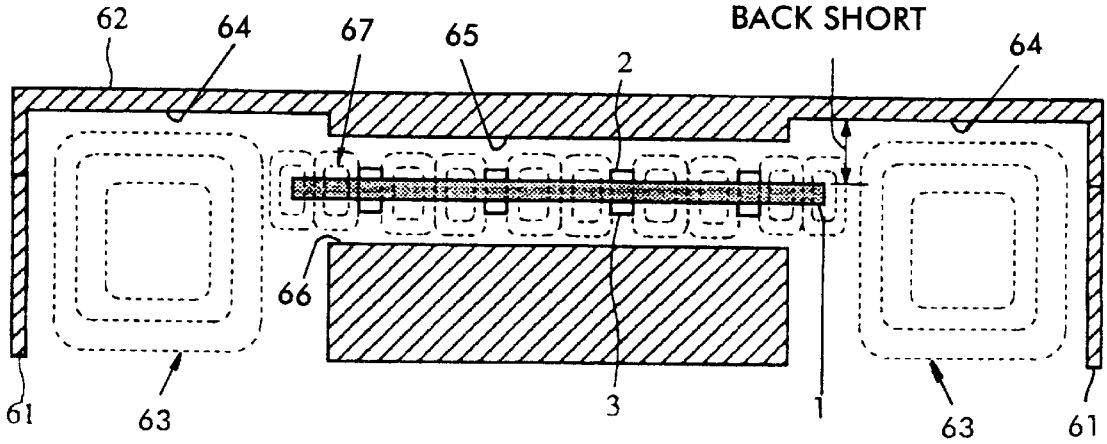

FIG. 5A is a cross section parallel to the plane of the dielectric plate 1, and FIG. 5B is a vertical section perpendicular to the plane of the dielectric plate 1. The configuration of the electrodes 2 and 3 respectively formed on the top and bottom surfaces of the dielectric plate 1 is similar to that shown in FIGS. 3A and 3B. The electrode 2 is provided with the electrode openings 4*a* through 4*e,* while the electrode 3 is provided with the electrode openings 5*a* through 5*e*. When electromagnetic waves propagate in the waveguide perpendicularly to the plane of the dielectric plate 1, as discussed above, a rectangular slot mode of the resonators formed at both ends of the dielectric plate 1 is magnetically coupled to the TE10 mode propagating in the waveguide.

Figure 6:
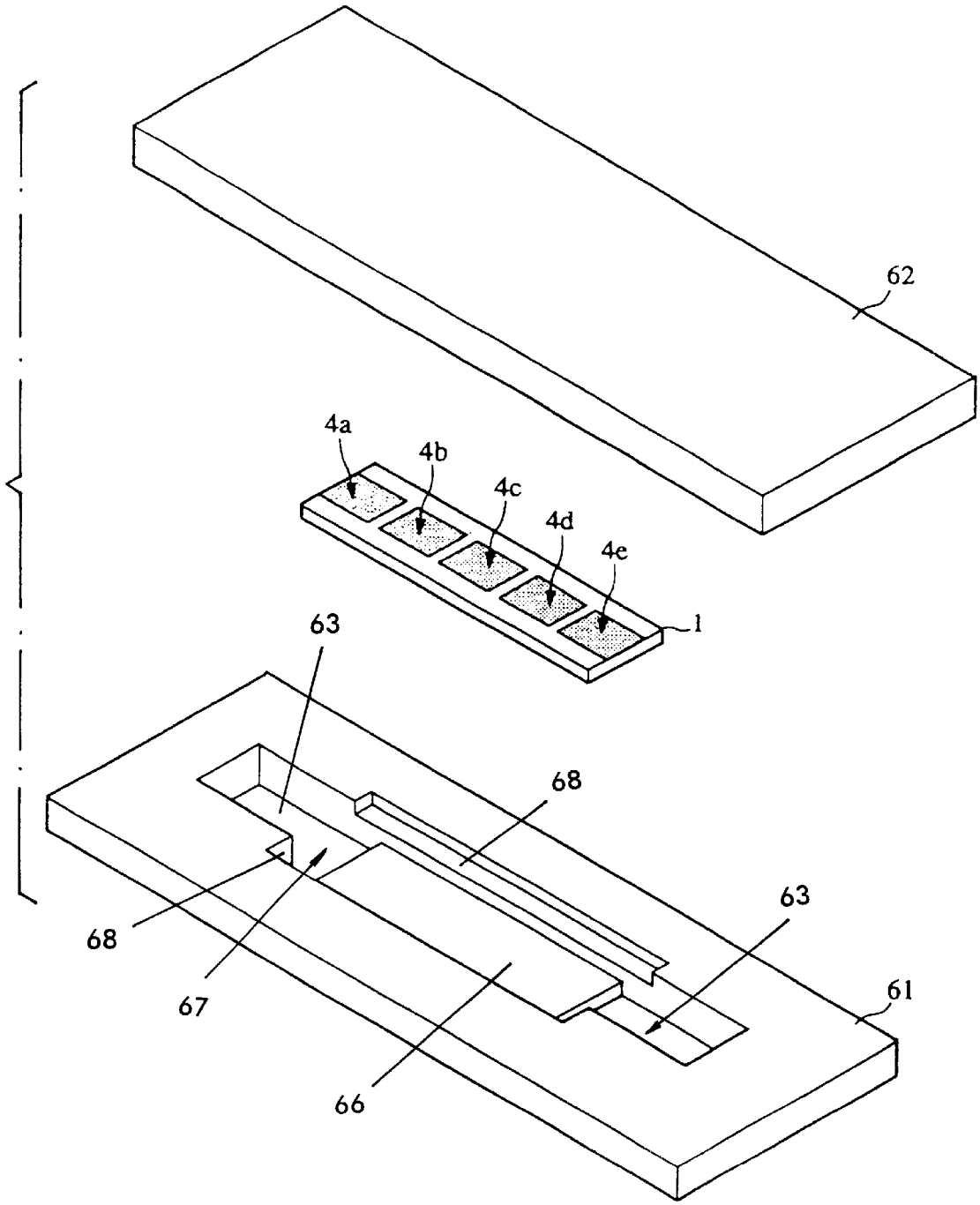
FIG. 6 is an exploded perspective view illustrating the filter shown in FIGS. 5A and 5B.

FIG. 6 is an exploded perspective view illustrating the filter shown in FIGS. 5A and 5B. A package cover 62 is placed on the top of a package base 61. A recess 67 including channels 68 is formed in the package base 61 to receive the dielectric plate 1 therein. The dielectric plate 1 is placed in the recess, and the package cover 62 is placed on top of the dielectric plate 1. As a result, the dielectric plate 1 is held between the inner surfaces of the package base 61 and the package cover 62 with predetermined spacings, each being for example 1.5 mm in this embodiment, defined respectively between the dielectric plate 1 and the portion 65 of the package cover 62 above the dielectric plate, and the portion 66 of the package base 61 below the dielectric plate. Two openings 63 provided in the package base 61 form part of the above-described waveguide. Recesses 64 are also formed on the inner surface of the package cover 62 to form the respective end faces of the waveguides.

According to the above-described configuration in which the dielectric plate 1 is disposed perpendicularly to the propagating direction of electromagnetic waves in the waveguide, the mountability of the filter can be improved. More specifically, the opened faces (the bottom faces shown in FIG. 5B) of the waveguide are simply mounted on or disposed in proximity with the surface of a circuit board. Then, the waveguide is magnetically coupled to a line, such as a microstrip line, formed on the circuit board. Accordingly, the mountability of the filter shown in FIGS. 5A and 5B and the connection between the waveguide and a circuit module on which the filter is mounted are significantly improved.

Figure 7:
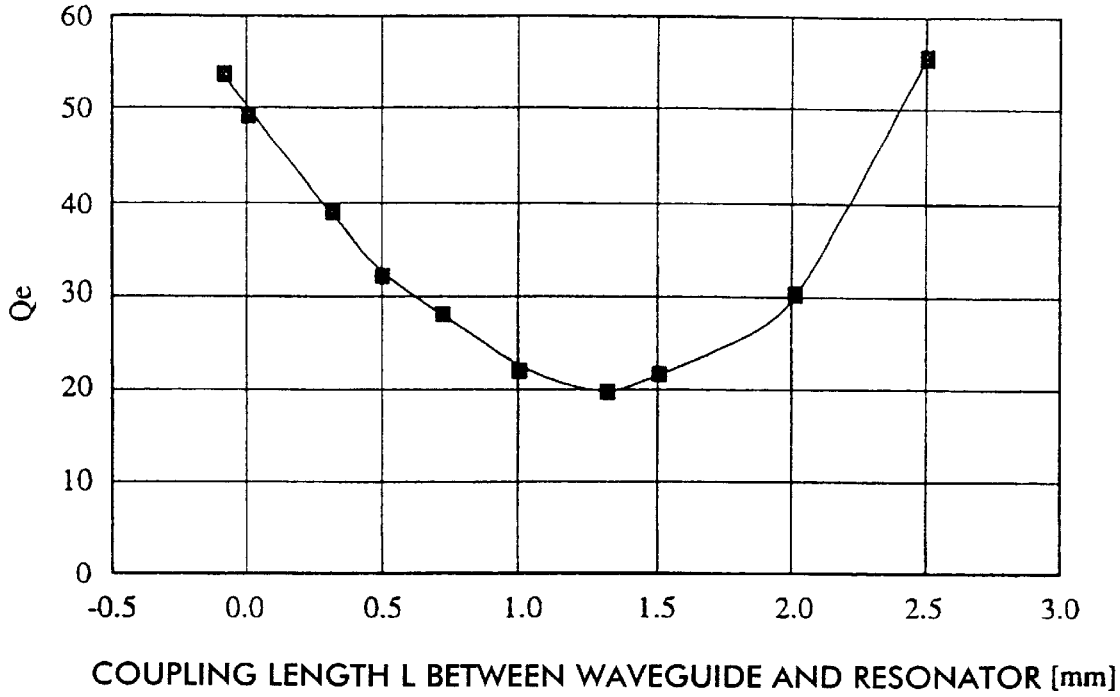
FIG. 7 illustrates the relationship between external Qe and the coupling length L of a waveguide and a resonator of the filter shown in FIGS. 5A and 5B.

FIG. 7 illustrates the relationship between the external Q (Qe) and the coupling length L of the resonators formed at both ends of the dielectric plate 1 and the waveguide 7 shown in FIGS. 5A and 5B. The conditions for calculating the above-described values are as follows:

waveguide: WR-22 (opening 7.11×3.55 mm);

dielectric plate: $\epsilon r$=24, thickness=0.4 mm;

resonator: ¾-wavelength resonator having a length of 1.976 mm and a width of 1.8 mm;

spacing from the top and bottom surfaces of the dielectric plate to the package cover 62 and the package base 61, respectively: 1.5 mm, measured near the middle of FIG. 5B; and back short (distance from the end face of the waveguide to the electrode surface of the dielectric plate): 2.5 mm.

FIG. 7 reveals that the external Qe becomes a minimum when the coupling length L is about 1.3 mm. In this case, the coupling length L corresponds to a position at ½ wavelength from the opened end of the ¾-wavelength resonator toward the resonator, and the electric field of the resonator becomes a maximum at this position. The external Qe can be set by the coupling length L between the waveguide and the resonator.

When the coupling length L is set in a range from 0 to the length of the resonator, as shown in FIG. 7, the external Qe can easily be adjusted (set) in a small range of values without sharply fluctuating.

Figure 8:
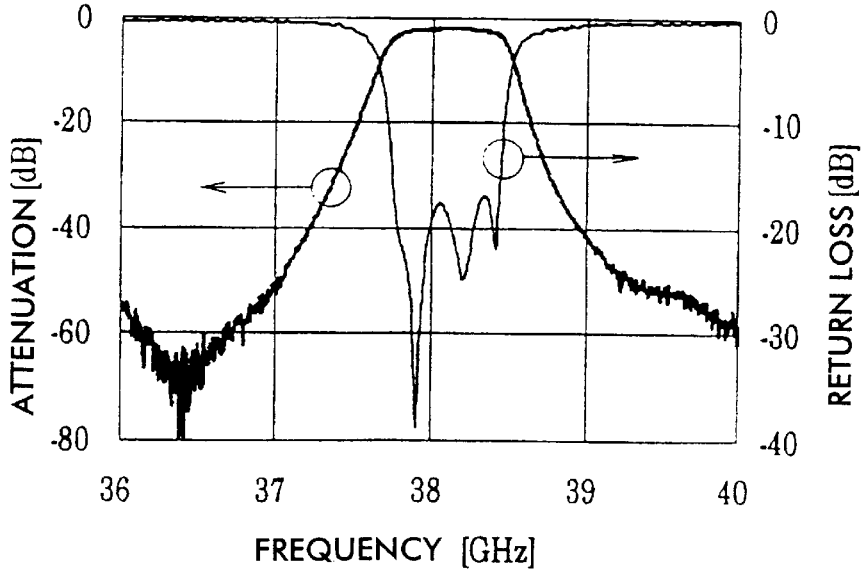
FIG. 8 illustrates pass-band characteristics and reflection characteristics of the filter shown in FIGS. 5A and 5B.

FIG. 8 illustrates the band-pass characteristics and the reflection characteristics of the filter. The characteristics are as follows:

center frequency: 38.1 GHz;

pass bandwidth: 500 MHZ;

insertion loss in the pass band: 2.2 dB;

attenuation at fo±1.1 GHz: 50 dB or greater; and unloaded Q of the resonator: 820 for ¾-wavelength resonator and 790 for 1-wavelength resonator.

In the filter which exhibits characteristics shown in FIGS. 7 and 8, input/output-stage resonators disposed at the ends of the dielectric plate 1 are ¾-wavelength resonators, while the other resonators are 1-wavelength resonators. Alternatively, the input/output-stage resonators may be (2n−1)/4-wavelength resonators (n is an integer of 1 or more), and the other resonators may be (2n−1)/2-wavelength (n is an integer of 1 or more) resonators.

The filter shown in FIGS. 5A, 5B, and 6 may be used in a structure for connecting a waveguide to a planar dielectric transmission line (PDTL) in which opposing slots are formed on both surfaces of a dielectric plate. The filter may also be used in a device including a PDTL which uses a waveguide as an input/output portion.

Figure 9A:
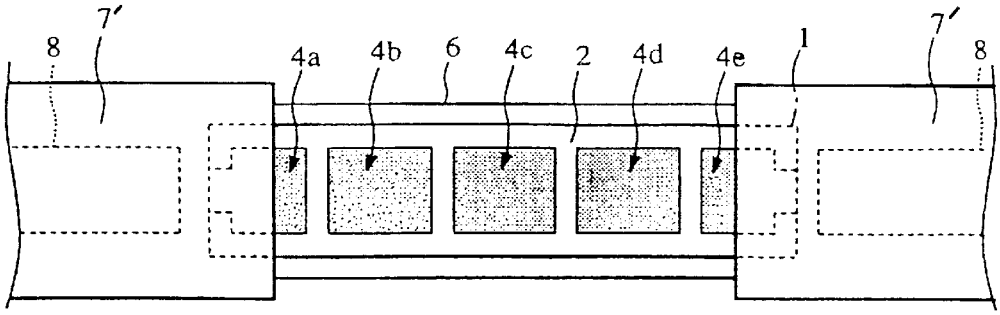
FIGS. 9A and 9B illustrate the configuration of a filter according to a sixth embodiment of the present invention.
Figure 9B:
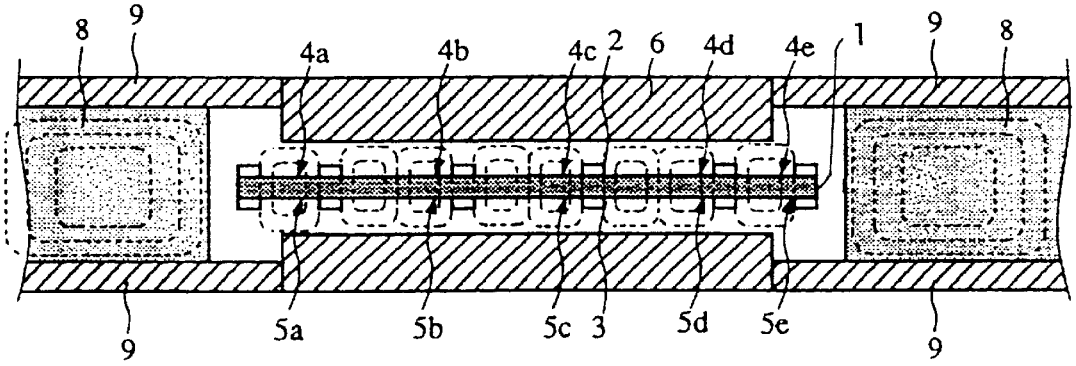

The configuration of a filter according to a sixth embodiment of the present invention is discussed below with reference to FIGS. 9A and 9B.

In this filter, an NRD guide 7' is used instead of the waveguide 7 shown in FIG. 4. More specifically, a dielectric strip 8 is interposed between upper and lower conductive plates 9 so as to form an NRD guide. The configuration of the resonators formed in the dielectric plate 1 is similar to that shown in FIG. 4. The magnetic field of a rectangular slot mode resonator formed in the dielectric plate 1 is perpendicular to the upper and lower conductive plates 9, and is thus coupled to the LSM mode of the NRD guide.

The width of the electrode openings (width of the opened ends) formed at both ends of the dielectric plate 1 is set so that the optimal external Qe between the resonator and the NRD guide can be obtained.

The resonators formed in the dielectric plate 1 are directly coupled to the NRD guide, as described above. This prevents the generation of conduction loss, which would otherwise be caused by an input/output line. As result, the insertion loss of the filter can be reduced.

A description is given below, with reference to FIG. 10, of the configuration of a duplexer, which is an example of a multiplexer, according to a seventh embodiment of the present invention.

Figure 10:
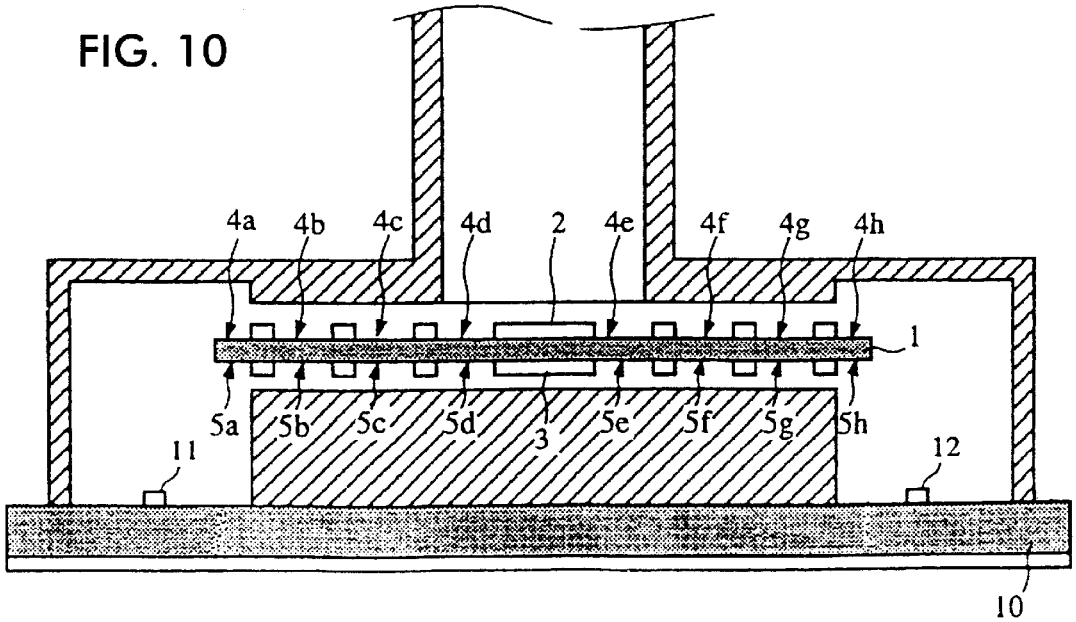
FIG. 10 illustrates the configuration of a duplexer according to a seventh embodiment of the present invention.

FIG. 10 is a vertical section perpendicular to the plane of the dielectric plate 1 and illustrates a duplexer mounted on a circuit board 10. The electrodes 2 and 3 are respectively formed on the top and bottom surfaces of the dielectric plate 1, and electrode openings 4*a* through 4*h* and 5*a* through 5*h* are also respectively formed on the top and bottom surfaces of the dielectric plate 1. Among the electrode openings, four resonators formed by the electrode openings 4*a* through 4*d* and 5*a* through 5*d* form a transmission filter, and four resonators formed by the remaining electrode openings 4*e* through 4*h* and 5*e* through 5*h* form a reception filter. The resonator formed by the electrode openings 4*a* and 5*a* is directly coupled to a transmission waveguide, while the resonator formed by the electrode openings 4*h* and 5*h* is directly coupled to the reception waveguide. The resonator formed by the electrode openings 4*d* and 5*d* and the resonator formed by the electrode openings 4*e* and 5*e* are directly coupled to an antenna waveguide. The transmission waveguide is coupled to a microstrip line 11 formed on the circuit board 10, while the reception waveguide is coupled to another microstrip line 12 also formed on the circuit board 10. With this configuration, a duplexer using the above-described waveguides as input/output portions is formed.

The configuration of a communication apparatus according to an eighth embodiment of the present invention is now discussed with reference to FIG. 11.

Figure 11:
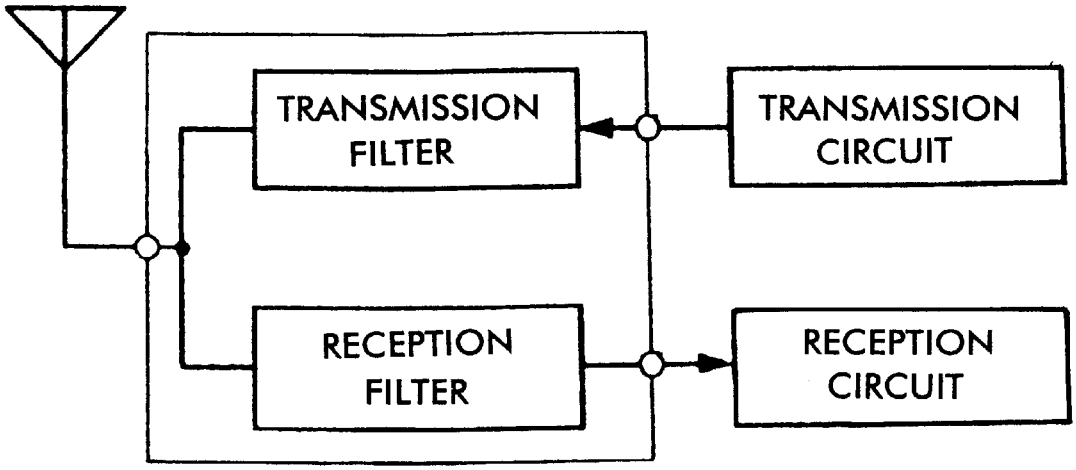
FIG. 11 is a block diagram illustrating the configuration of a communication apparatus according to an eighth embodiment of the present invention.

In the communication apparatus shown in FIG. 11, the duplexer formed of a transmission filter and a reception filter shown in FIG. 10 is used. A transmission circuit and a reception circuit are formed for example on the circuit board 10 shown in FIG. 10. A transmission-signal input port corresponds to the microstrip line 11 shown in FIG. 10, while a reception-signal output port corresponds to the microstrip line 12 shown in FIG. 10. An antenna port corresponds to the antenna waveguide shown in FIG. 10. The transmission circuit and the reception circuit are each provided with the band-pass filter shown in one of FIGS. 1A through 5B.

By using a small filter or duplexer having predetermined characteristics, it is possible to provide a small and light communication apparatus.

Although embodiments of the invention have been disclosed herein, the invention is not limited thereto, but rather extends to all modifications and variations that would occur to those having the ordinary level of skill in the art.

What is claimed is:

1. A filter comprising:

a resonator comprising a pair of openings formed respectively in electrodes on two opposed surfaces of a dielectric plate, wherein the electrode openings face each other through said dielectric plate; and a waveguide arranged at an end of said dielectric plate and directly coupled to said resonator or without an input/output line.

2. A filter according to claim 1, wherein said resonator is coupled to said waveguide at an opened end of said resonator.

3. A filter according to claim 2, wherein said resonator has an overall width, and said opened end of said resonator has a narrowed width which is less than said overall width, wherein said narrowed width defines an external Q of said filter.

4. A filter according to any one of claims 2 and 3, wherein electromagnetic waves propagate in said waveguide perpendicularly to surfaces of said dielectric plate on which said electrode openings are formed.

5. A filter according to claim 1, wherein said waveguide is an NRD guide.

6. A filter comprising:

a resonator comprising a pair of openings formed respectively in electrodes on two opposed surfaces of a dielectric plate, wherein the electrode openings face each other through said dielectric plate; and a waveguide directly coupled to said resonator, wherein said resonator is coupled to said wave guide at an opened end of said resonator, wherein electromagnetic waves propagate in said waveguide perpendicularly to surfaces of said dielectric plate on which said electrode openings are formed, and wherein said opened end is inserted into said waveguide by an amount no greater than the maximum length from one end to the other end of the electrode opening in the longitudinal direction of the dielectric plate.

7. A filter comprising:

a resonator comprising a pair of openings formed respectively in electrodes on two opposed surfaces of a dielectric plate, wherein the electrode openings face each other through said dielectric plate; and a waveguide directly coupled to said resonator, wherein said resonator is coupled to said waveguide at an opened end of said resonator, wherein electromagnetic waves propagate in said waveguide perpendicularly to surfaces of said dielectric plate on which said electrode openings are formed, wherein said opened end is inserted into said waveguide by an amount no greater than the maximum length from one end to the other end of the electrode opening in the longitudinal direction of the dielectric plate, and wherein a length of said resonator directly coupled to said waveguide is $(2n-1)/4$ of a resonant wavelength (wherein n is an integer of one or more), and said opened end is inserted into said waveguide by an amount corresponding to $(m-1)/2$ (wherein m ranges from 2 to n) of the resonant wavelength in the longitudinal direction of said electrode opening.

8. A multiplexer comprising:

a plurality of filters, each filter of said plurality of filters comprising:

a resonator comprising a pair of openings formed respectively in electrodes on two opposed surfaces of a dielectric plate, wherein the electrode openings face each other through said dielectric plate; and a waveguide directly coupled to said resonator, wherein said each filter has first and second input/output ports, and a pair of first input/output ports corresponding respectively to two of said plurality of filters are connected together.

9. A communication apparatus comprising the multiplexer set forth in claim 8, and a high-frequency circuit comprising at least one of a transmission circuit and a reception circuit, connected to at least one of said second input/output ports of said two of said filters.

10. A communication apparatus comprising:

a filter comprising:

a resonator comprising a pair of openings formed respectively in electrodes on two opposed surfaces of a dielectric plate, wherein the electrode openings face each other through said dielectric plate;

a waveguide directly coupled to said resonator; and a high-frequency circuit comprising at least one of a transmission circuit and a reception circuit connected to said filter.

* * * * *